364-422 SR
1/13/87 XR 4,636,934

United States Patent [19]
Schwendemann et al.

[11] Patent Number: 4,636,934
[45] Date of Patent: Jan. 13, 1987

[54] WELL VALVE CONTROL SYSTEM

[75] Inventors: Kenneth L. Schwendemann, Lewisville, Tex.; Oliver W. McCracken, Pauls Valley, Okla.; Cary G. Mondon, Carrollton; Larry C. Wortham, Garland, both of Tex.

[73] Assignee: Otis Engineering Corporation, Dallas, Tex.

[21] Appl. No.: 612,409

[22] Filed: May 21, 1984

[51] Int. Cl.[4] ..... G06F 11/08; G06F 15/46; G05D 7/06

[52] U.S. Cl. ..... 364/132; 137/624.18; 166/336; 340/870.16; 364/422; 364/550

[58] Field of Search ..... 364/132, 133, 138, 139, 364/422, 550, 551, 569, 571; 73/154; 137/624.11, 624.12, 624.15, 624.18; 166/336, 363, 368; 340/870.11, 870.16

[56] References Cited

U.S. PATENT DOCUMENTS

| | | | |
|---|---|---|---|
| 3,071,188 | 1/1963 | Raulins | 166/365 |
| 3,411,576 | 11/1968 | Taylor | 166/363 X |
| 3,870,101 | 3/1975 | Helmus | 166/368 X |
| 3,955,623 | 5/1976 | Aumann | 166/368 X |
| 3,967,647 | 7/1976 | Young | 137/614.11 |
| 4,107,697 | 8/1978 | McCracken | 346/33 R |
| 4,161,782 | 7/1979 | McCracken | 364/571 |
| 4,174,729 | 11/1979 | Roark et al. | 137/487.5 |
| 4,180,860 | 12/1979 | Driscoll et al. | 364/139 |
| 4,215,746 | 8/1980 | Hallden et al. | 137/557 |
| 4,234,043 | 11/1980 | Roberts | 166/336 |
| 4,304,001 | 12/1981 | Cope | 364/132 X |
| 4,347,564 | 8/1982 | Sugano et al. | 364/132 |
| 4,352,376 | 10/1982 | Norwood | 137/624.15 |
| 4,355,365 | 10/1982 | McCracken et al. | 364/569 |
| 4,375,239 | 3/1983 | Barrington et al. | 166/336 |
| 4,417,470 | 11/1983 | McCracken et al. | 73/154 |
| 4,499,584 | 2/1985 | Howarth | 340/870.11 X |
| 4,507,735 | 3/1985 | Moorehead et al. | 364/132 X |
| 4,526,228 | 7/1985 | Wynn | 166/53 |
| 4,530,045 | 6/1985 | Petroff | 364/138 |

OTHER PUBLICATIONS

World Oil Composite catalog 1980–1981: Otis Well Testing Equipment and Service, pp. 5958,5959 of interest, published by Gulf Publishing Company, Houston, TX.

World Oil Composite catalog 1982–1983: Control Systems, pp. 3688, 4305 and 691, 694, 695, Published by Gulf Publishing Compay, Houston, TX.

*Primary Examiner*—Felix D. Gruber
*Attorney, Agent, or Firm*—Thomas R. Felger

[57] ABSTRACT

An electro/hydraulic system for controlling remotely located valves or other types of hydraulically powered equipment. The electrical system uses multiple microprocessors to send, validate, and execute commands. Microprocessors at the central control station constantly communicate with and monitor similar microprocessors at remote locations. The validation of commands increases safety and reliability of the present invention as compared to direct electrical control systems. The electrical components of the present invention greatly decrease the lapse time between initiating a command at the central location and equipment response at the remote location. The system also monitors and displays temperature, pressure, and valve position.

23 Claims, 10 Drawing Figures

WELL VALVE CONTROL SYSTEM

BACKGROUND OF THE INVENTION

1. Field of the Invention

The present invention relates to a system for electro/-hydraulically controlling one or more remotely located valves, and more particularly, to a system for controlling one or more well valves in order to optimize testing of hydrocarbon producing formations. The system also provides for monitoring of selected parameters such as pressure, temperature, and valve position.

2. History of the Prior Art

Each underground hydrocarbon producing formation, known as a reservoir, has its own characteristics with respect to permeability, porosity, pressure, temperature, hydrocarbon density and relative mixture of gas, oil and water within the formation. The cost of building and maintaining a large offshore oil and gas production facility can easily exceed $500,000,000 over the life of the facility. Therefore, extensive testing, sometimes for many months, must be conducted of each new reservoir before the commitment to establish an offshore production facility can be justified. Testing of offshore exploratory wells typically requires a sophisticated system of flow control valves at various locations within the well bore, on the ocean floor, and on the drilling vessel. These valves are designed both to control formation fluid flow for optimum test results and for safety during emergency conditions such as a storm forcing the drilling vessel to leave the well site.

Examples of surface and subsurface well testing equipment are shown on pages 5958 and 5959 of the 1980–81 Composite Catalog published by World Oil.

Suitable apparatus to control fluid flow through a subsea wellhead is shown in Taylor U.S. Pat. No. 3,411,576, issued Nov. 19, 1968. Taylor teaches the first use of subsea test trees (SSTT) suspended in the wellhead and associated blowout preventers to control fluid flow during testing of offshore wells. In the Taylor patent multiple valves with their operators are left in the wellhead, and the production string above the wellhead is released when a disconnect is required such as during adverse weather conditions. Later versions of subsea test trees are shown in the patents to Aumann, U.S. Pat. No. 3,955,623 issued May 11, 1976; Young, U.S. Pat. No. 3,967,647 issued July 6, 1976; and Helmus, U.S. Pat. No. 3,870,101 issued Mar. 11, 1975. U.S. Pat. No. 4,234,043 to William M. Roberts and U.S. Pat. No. 4,375,239 to Burchus Q. Barrington et al disclose subsea test trees designed for deep water well sites. U.S. Pat. No. 3,071,188 to G. M. Raulins discloses a latch assembly satisfactory for use with the present invention.

The above referenced patents are incorporated for all purposes within this application.

Under certain circumstances, particularly deep water testing, a significant amount of time may elapse between initiation of a hydraulic control signal onboard the drilling vessel and the response of a remotely located valve to this signal. Various electrical and acoustic actuators have been developed to reduce the elapsed time before a subsea test tree responds to a signal on a drilling vessel. One limitation of such prior art systems is that spurious electrical or acoustic signals may trigger undesired and possibly even dangerous valve operations.

As reservoir testing technology becomes more sophisticated, more is learned about testing procedures and data requirements to accurately evaluate the size of a reservoir. It is clear that a system which provides for reliable and quick operation of various flow control valves will improve the accuracy of well testing. In addition, a system which constantly monitors critical well parameters, system operating limits and valve status adds to the safety of well testing and allows better correlation between measurements of formation fluid flow and equipment changes affecting this flow. Microprocessor technology offers the opportunity to measure many parameters and to rapidly respond to changes in these parameters. It is highly desirable to provide a fully programmable system which can quickly and reliably operate multiple flow control valves remotely located from a central location and measure responses to any change in a valve's status. The present invention provides such full programmable capability to optimize both safety and accuracy of well testing.

The valve control system of the present invention is not limited to controlling multiple remotely located valves during well testing. The system can be modified to control remotely located valves during long term production from an oil and gas well or any other system of remotely located valves or hydraulic equipment. The present invention is described for use in a well testing system which has a retainer valve with a locking mechanism, a subsea test tree, and an emergency disconnect latch assembly.

SUMMARY OF THE INVENTION

An object of the present invention is to provide an electro/hydraulic system which measures various well parameters, analyzes those measurements based upon preprogrammed considerations, and controls remotely located valves to provide for optimum production testing from the well.

Another object of the present invention is to provide a system which includes flow control valves, parameter sensing equipment, programmable electronic controllers, and hydraulic accumulators for opening and closing the flow control valves for optimum formation testing. In addition, the system can monitor such parameters as hydraulic supply fluid pressure, accumulator pressure, valve position, wellhead production fluid pressure, wellhead production fluid temperature, wellhead production flow rate, riser pressure, system temperature, voltages at selected components, contact closure, and latch position to optimize production testing from the well.

An additional object of the present invention is to provide visual and/or audible warnings to personnel conducting well testing when a critical parameter exceeds programmed limits. The present invention allows these limits to be easily changed for various well conditions.

A further object of the present invention is to ensure that the latch assembly which joins the subsea test tree to the production tubing string thereabove is not activiated by a loss of electrical power nor by the failure of any microprocessor within the system. The latch assembly is activated only by reversing the polarity of the electrical signal supplied thereto.

Another object of the present invention is to provide a system which can be used to train personnel to conduct well testing under simulated conditions and the proper response to various emergency conditions.

An important feature of the present invention is that command signals are sent from the central location to the remote location, stored in a programmable memory, transmitted back (echoed) to the central location for validation, and a unique enable signal sent from the central location prior to any response to the command signal. Constant comparison and validation of signals between the central station and remote location ensure electrical continuity and that components are functioning satisfactorily to allow continued well testing.

A further object of the present invention is to send multiple commands to close the SSTT prior to unlatching the SSTT from the production tubing string thereabove.

Another important feature of the present invention is the use of a monitor having color graphics capability. Such a monitor provides rapid, visual verification of valve closure or latch actuation by changing the color of the appropriate display in response to a change in the associated parameter. Color graphic capability is very helpful for personnel training.

A still further object of the present invention is to provide an electro/hydraulic system for oil/gas production testing which is fully programmable and has a display panel which allows periodic re-programming thereof.

Other objects and advantages of the present invention will be readily apparent to those skilled in the art from studying the written description in conjunction with the drawings and claims.

DESCRIPTION OF THE PREFERRED EMBODIMENTS

Figure 1:
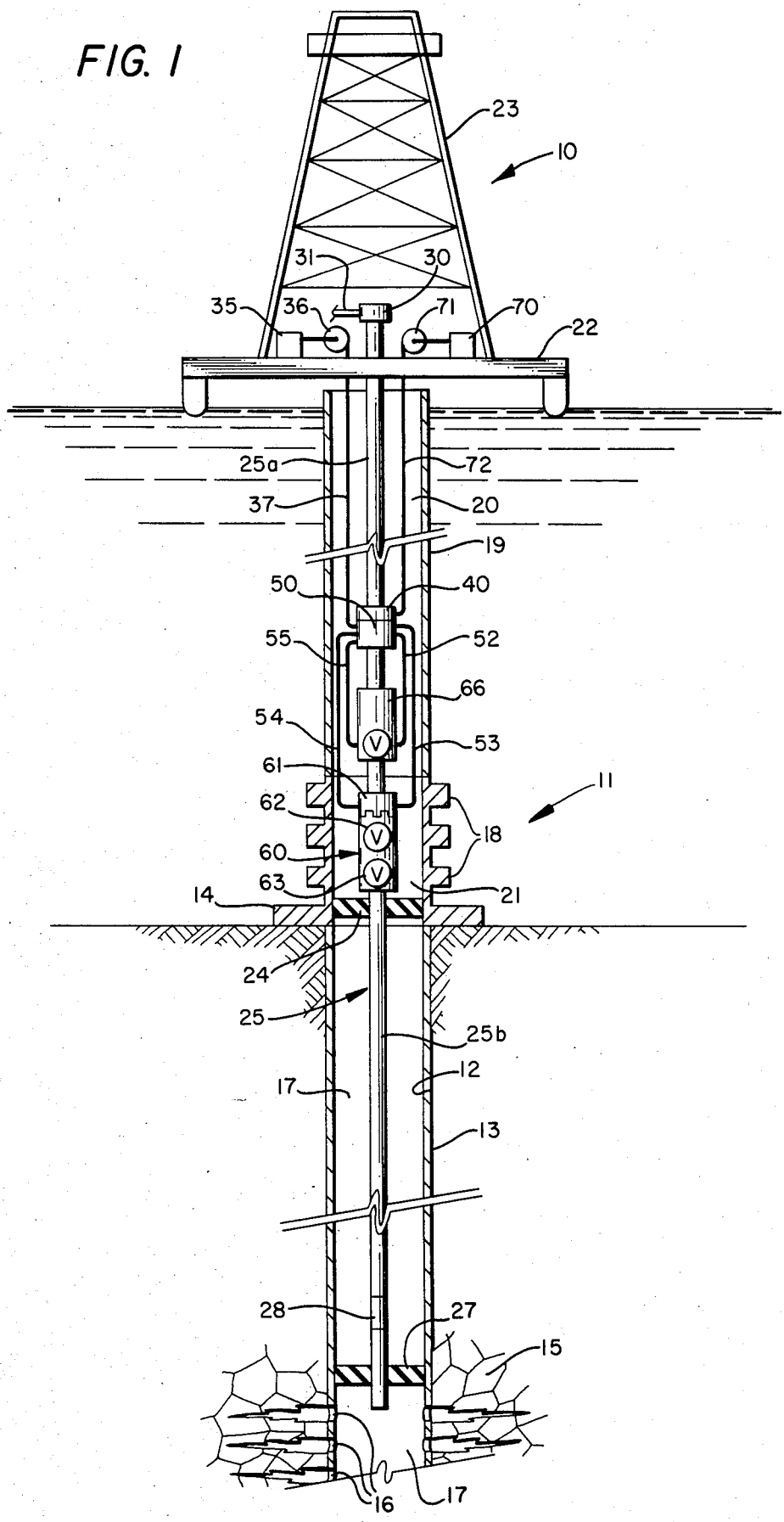
FIG. 1 is a schematic drawing of a drilling vessel and well testing equipment including a subsea test tree having electrical and hydraulic systems constructed in accordance with the teachings of the present invention.

A typical arrangement for conducting testing of offshore oil and gas wells is shown in FIG. 1. This arrangement includes floating work station or drilling vessel 10 located over a submerged well site 11. The well comprises well bore 12 lined with casing string 13 extending from wellhead 14 to a potential underground hydrocarbon producing formation 15. A plurality of perforations 16, near the lower end of casing string 13 and extending radially therethrough, allow fluid communication between formation 15 and bore 17 of casing 13.

Wellhead 14 includes blowout preventer stack 18 with marine riser 19 attached thereto and extending upwardly to drilling vessel 10. Marine riser 19 has bore 20 extending therethrough and concentrically aligned with bore 21 through wellhead 14 and bore 17 of casing string 13. Well site 11 can be drilled, tested, and completed through aligned bores 20, 21, and 17. Drilling vessel 10 provides the required working deck 22, derrick 23, and associated equipment to accomplish these tasks.

After well bore 12 has been drilled, formation 15 must be tested to determine if the recoverable reserves of oil or gas justify the expense of further completing the well site to place it into commercial production. Such well testing is frequently conducted by installing production test string 25 between drilling vessel 10 and the vicinity of perforations 16. As shown in FIG. 1, production test string 25 extends longitudinally through bores 20, 21, and 17 and is concentrically aligned therewith. Derrick 23 is used to install and remove test string 25 as required. During normal testing of formation 15, production test string 25 may be suspended from and supported by wellhead closure 24. Test string 25 comprises two main portions, upper test string **25*a* and lower test string 25*b*, releasably engaged to each other by latch assembly 61. Well packer 27 is carried by lower string 25*b* to form a fluid barrier with the interior of casing 13 adjacent thereto above perforations 16. Well packer 27 directs formation fluid flow into production test string 25. Various downhole well tools 28 may be included within lower string 25*b***. Examples of such downhole well tools are landing nipples, subsurface safety valves, flow control valves, pressure and temperature recorders, etc.

Starting at working deck 22, upper string **25*a* includes surface test tree 30 and associated valves which control fluid flow from test string 25 into appropriate production test facilities (not shown) via flowline 31. Upper string 25*a* also includes sealed atmospheric chamber 40 and hydraulic accumulator 50 disposed within marine riser 19 above wellhead 14. Atmospheric chamber 40 is preferably divided into two separate chambers 40*a* and 40*b*. Additional hydraulic accumulators 50** may be added as required. These modifications will be explained later in detail.

During normal well testing, upper string **25*a* is attached to and communicates fluid with lower string 25*b* via subsea test tree (SSTT) 60. Production test string 25 including SSTT 60 is normally raised and lowered as a single unit. During emergency conditions when drilling vessel 10 must be moved quickly away from well site 11, latch assembly 61 is incorporated into SSTT 60 to disengage upper string 25*a* from lower string 25*b*. The portion of SSTT 60 containing valves 62 and 63 along with lower string 25*b* is then left suspended from wellhead 14. Valves 62 and 63 are designed to close during such emergency disconnect to prevent undesired escape of well fluids from lower string 25*b*. Preferably, SSTT 60 is designed to allow at least one set of blowout preventers 18 to close when latch assembly 61 is actuated to allow removal of upper string 25*a***. An example of an SSTT and latch assembly satisfactory for use with the present invention is disclosed in U.S. patent application Ser. No. 329,920 filed Dec. 11, 1981.

Hydraulic System

Figure 2:
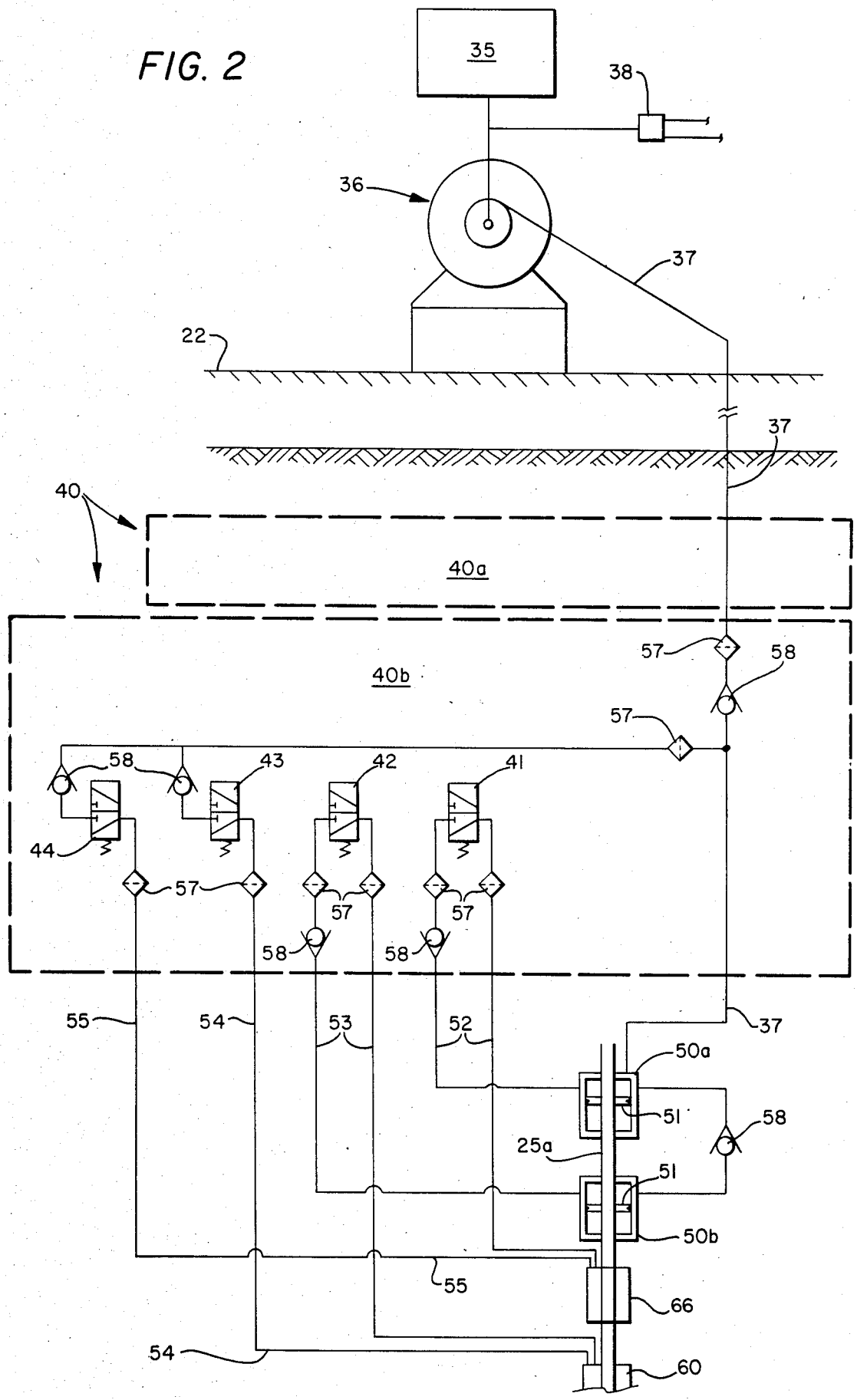
FIG. 2 is a schematic drawing of the hydraulic system and related components constructed in accordance with the teachings of the present invention to operate the well testing equipment of FIG. 1.

Hydraulic control manifold 35 located on working deck 22 contains pumps, valves, gauges, and fluid sources normally used to operate an SSTT and other downhole well valves. Hose reel 36 and high pressure conduit 37 communicate hydraulic control fluid from manifold 35 to accumulator 50. In FIG. 2 the control fluid system is shown in more detail with two accumulators 50*a* and 50*b* for increased downhole control fluid capacity. The number of accumulators can be varied as required. Each accumulator 50*a* and 50*b* is essentially a large cylindrical fluid reservoir carried by upper string 25*a*. The capacity of accumulators 50*a* and 50*b* is designed to allow multiple cycling of all downhole equipment following damage to conduit 37. Movable piston 51 divides each accumulator into two variable volume chambers, one for a nitrogen charge and the other to receive hydraulic fluid from conduit 37. The use of nitrogen charged accumulators is a well-known means to maintain a downhole supply of control fluid at a relatively constant pressure for operating well valves. In FIG. 2 the control fluid chambers of accumulators 50*a* and 50*b* are connected in series with conduit 37. Alternatively, the control fluid chambers could be connected in parallel with conduit 37. For this embodiment of the invention, control fluid from accumulator 50*a* is supplied to retainer valve 66 via solenoid valve 41 and fluid lines 52. Control fluid from accumulator 50*b* is supplied to SSTT 60 via solenoid valve 42 and fluid line 53. Control fluid is also supplied directly from conduit 37 to SSTT 60 via solenoid valve 43 and fluid line 54. Control fluid is also supplied directly from conduit 37 to retainer valve 66 via solenoid valve 44 and fluid line 55.

Atmospheric chamber 40 is divided into two sections, electronic chamber 40*a* and valve and transducer chamber 40*b*. Solenoid valves 41 through 44 are located within chamber 40*b*. These valves have a conduit (not shown) which vents hydraulic fluid into the annulus formed by bore 20 surrounding chamber 40*b*. The electronic components within chamber 40*a* are separated from chamber 40*b*. When electrical power is supplied to the solenoid of each valve 41 through 44, the respective valve shifts to close its vent path and to allow hydraulic fluid to flow therethrough. When the solenoid is de-energized, each valve 41 through 44 is spring loaded to its vent position. Chambers 40*a* and 40*b* are preferably filled with nitrogen for increased safety and to reduce corrosion of electrical and electronic components. Desiccant may also be placed in chamber 40 to control moisture.

Solenoid valves 41 through 44 are critical components. Solenoid valves satisfactory for use in the present invention are designated P/N 20950 3-WAY NC and are available from Futurcraft Corporation, 15430 Proctor Avenue, City of Industry, Calif. The use of solenoid valves allows a single hydraulic line to provide operating fluid for a plurality of remotely located valves. A major advantage of the present invention is the ability to individually control each valve and monitor its status.

Appropriate filters 57 and check valves 58 are installed within the hydraulic fluid lines as required by good engineering practices for high pressure hydraulic systems.

Electrical System

Figure 3A:
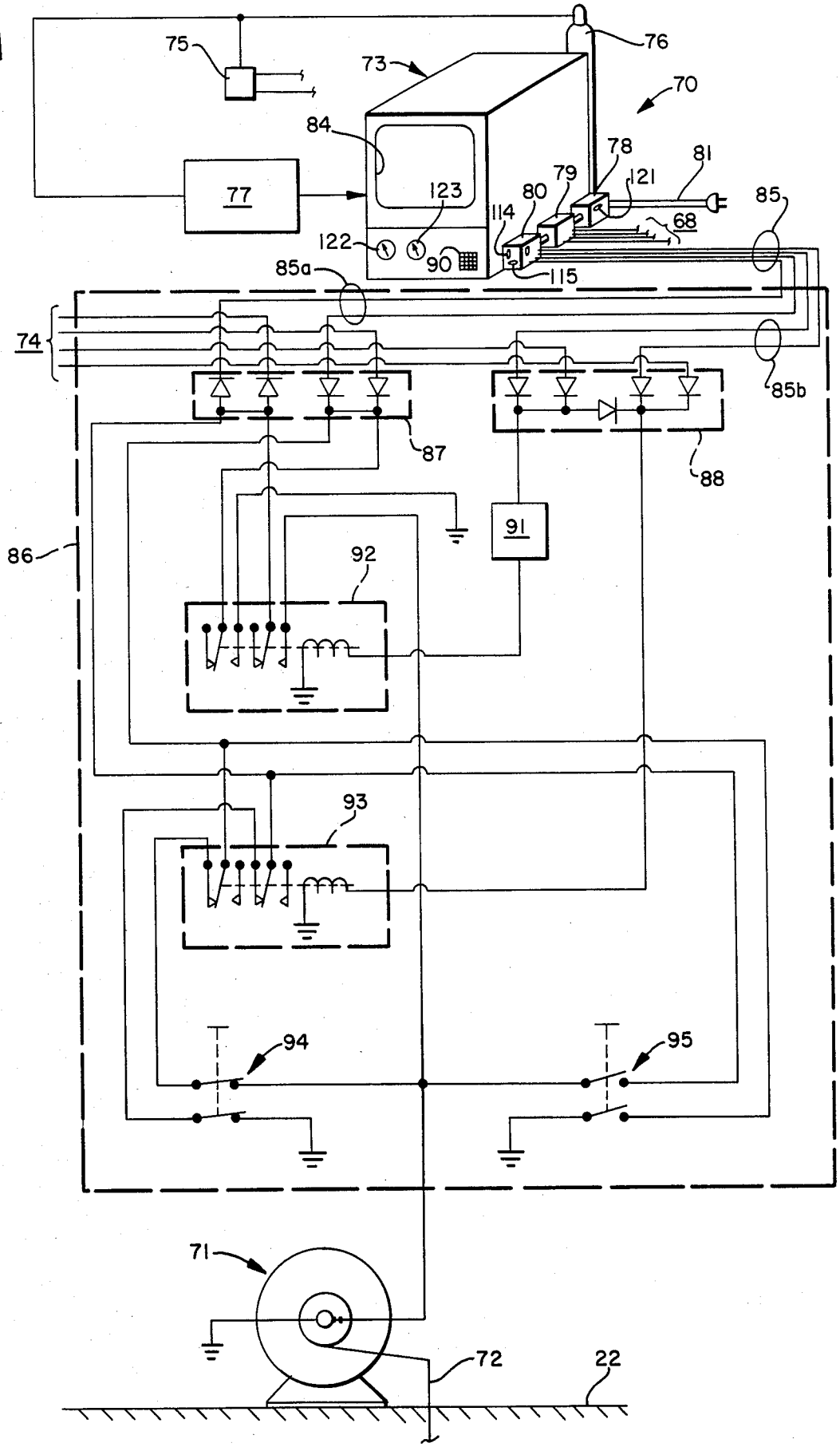
FIGS. 3A and B are schematic drawings of the electrical system and related components constructed in accordance with the teachings of the present invention to control and monitor the well testing equipment of FIG. 1.
Figure 3B:
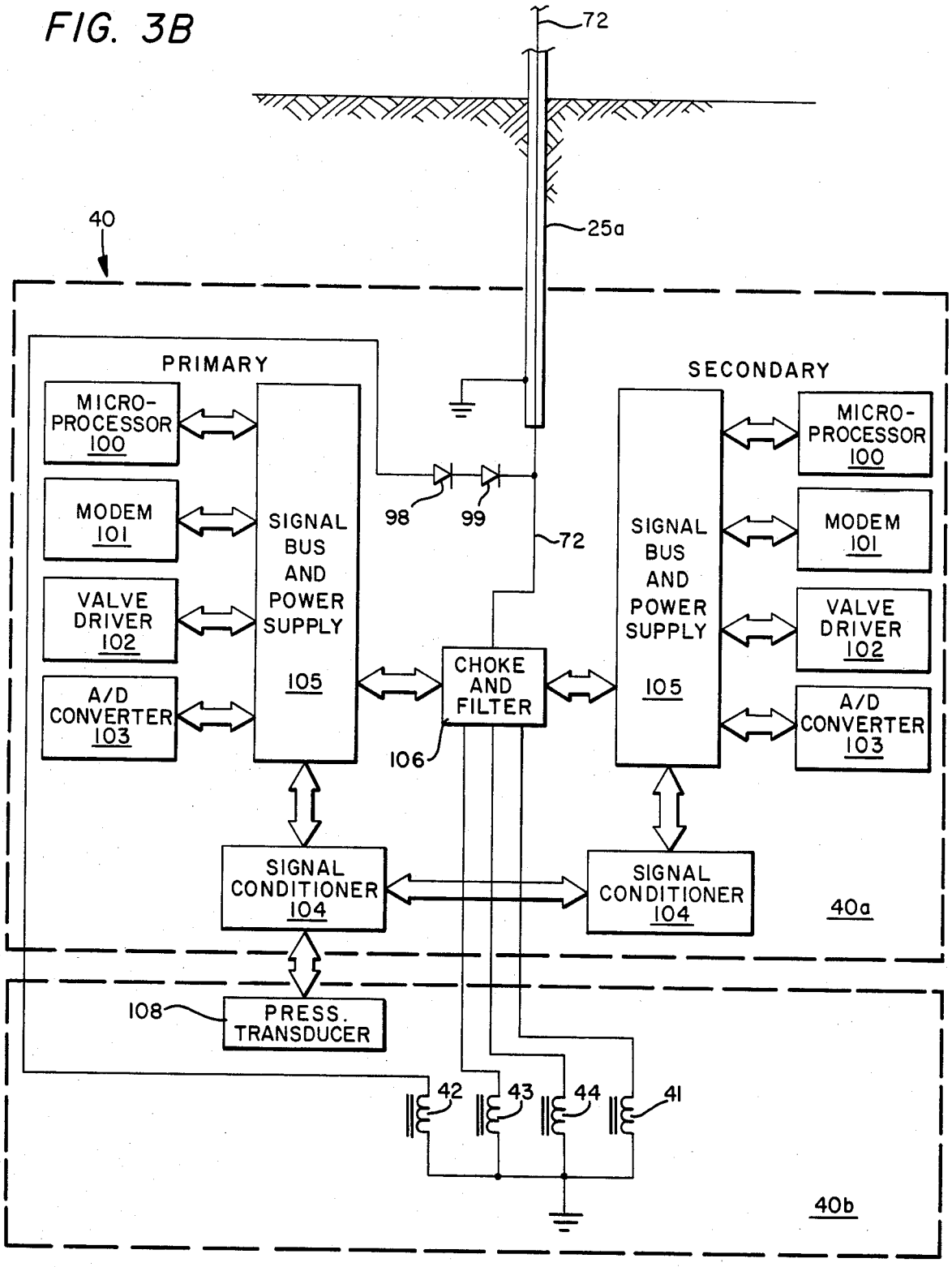

Electronic control panel 70 located on working deck 22 contains electrical power supplies, switches, microprossessors, monitors, etc., comprising a vital portion of the present invention. These components will be described later in detail. Single conductor electrical line 72, carried on cable reel 71, transmits electrical signals and power between the surface and subsurface components of the electrical system. Incorporating microprocessors and their associated programmable memory means into both the surface and subsurface electrical circuits allows single conductor electrical line 72 to transmit a large volume of information and commands in both directions. In addition, line 72 carries a DC voltage which directly controls latch assembly 61 to greatly increase the safety and reliability of well testing. FIG. 3A shows the electrical schematic for the surface components, and FIG. 3B shows the electrical schematic for the subsurface components located in atmospheric chamber 40. The DC voltage on line 72 provides the electrical power required to operate the subsurface components.

FIG. 3A shows only one control console 73. However, the present invention allows multiple consoles to be integrated into the system via terminals 74. These additional consoles can be placed at any desired location onboard drilling vessel 10. In addition to receiving signals from line 72, each console 73 can receive information from other sources such as pressure transducer 38 which monitors hydraulic system pressure or pressure transducer 75 which monitors nitrogen system pressure. This additional information is supplied to console 73 via terminals 68. If desired, the present invention allows information relating to production flow rate, temperature, and pressure; status of the production testing facility (not shown); and even status of drilling vessel 10 to be displayed on console 73. The capability to monitor and display such information on console 73 greatly adds to the safety and reliability of well testing.

A source of nitrogen such as bottle 76 and regulator 77 is provided at each control panel 70. A steady flow of nitrogen from regulator 77 to console 73 prevents the buildup of explosive or combustible gases within console 73. Explosion-proof boxes 78, 79, and 80 are attached to the exterior of console 73. Electrical power from cable 81 is supplied to console 73 via box 78. Box 79 is used to connect terminals 68 to console 73. Box 80 provides the electrical connection between console 73 and the other portions of the electrical system. Box 80 carries several important switches which will be described later in detail. Console 73 further provides video display screen or monitor 84 and key pad 90 which will also be described later in detail. If desired, video screen 84 can be replaced by other commercially available monitors such as liquid crystal displays, hard copy printers, or plasma display. A video screen with color graphics display capability is particularly desirable for personnel training.

Electrical signals are transmitted between console 73 and cable reel 71 via electrical cables 85. Explosion proof box 86 is located adjacent to cable reel 71 to provide terminals for cables 85. As previously noted, box 86 also provides terminals 74 for additional control consoles 73. Diode protection circuits 87 and 88 within box 86 are used to protect the electrical signals associated with operating solenoid valves 41, 42, 43, and 44. Diode protection circuits 87 and 88 prevent the loss or failure of one console 73 from affecting any other console 73. Therefore, well testing can be reliably controlled even though only one console 73 is operating. Box 86 also contains time delay relay 91, which controls the unlatch DC voltage signal, control relays 92 and 93, and manual switches 94 and 95. Manual switch 94 is normally closed. Opening switch 94 results in closing valves 62 and 63 in SSTT 60. Manual switch 95 is normally open. Closing switch 95 activates latch assembly 61 to disengage upper string 25*a* for SSTT 60. Manual switches 94 and 95 are preferably provided with interlocking handles to prevent unlatching of upper string 25*a* before valves 62 and 63 are closed. Placing these manual switches at cable reel 71 provides backup protection if neither console 73 can be operated.

Console 73 generates two types of signals, a modem signal and a DC signal. The modem signal is modulated American Standard Code for Information Interchange (ASCII). The DC signal which controls the latch assembly is produced by reversing the polarity of the DC voltage on line 72. Single conductor line 72 carries these signals to the electrical circuits contained within atmospheric chamber 40*a*. The DC signal on line 72 is transmitted directly via diodes 98 and 99 to solenoid valve 42 which controls the latch assembly. This arrangement bypasses the microprocessors and other electrical components whose failure might cause an undesired disconnect of upper string 25*a* from SSTT 60.

Figure 5:
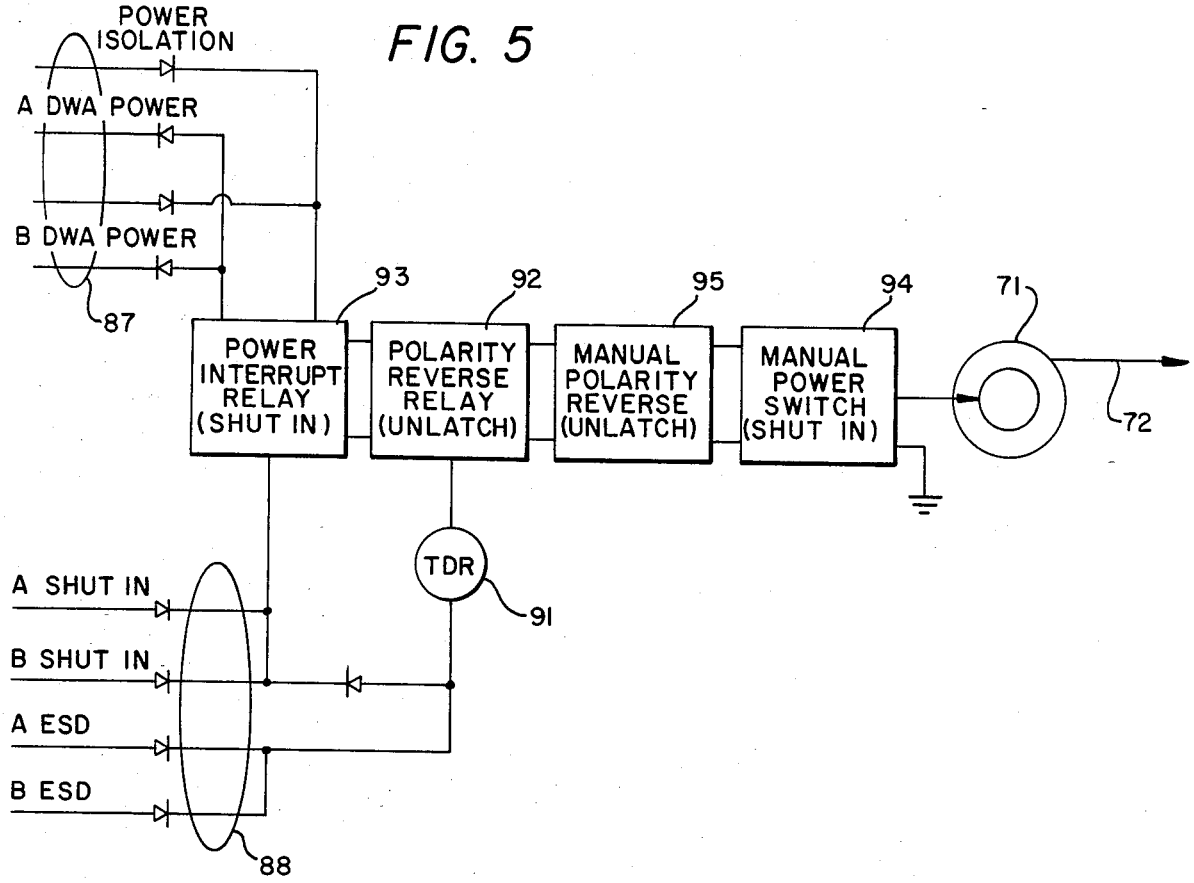
FIG. 5 is a block diagram of a portion of the electrical circuit shown in FIG. 3A.

As best shown by the block diagram of FIG. 5, time delay relay 91 prevents immediate reversal of the DC voltage which controls solenoid valve 42. Therefore, an unlatch signal is first sensed by power interrupt relay 93 which causes SSTT valves 62 and 63 and retainer valve 66 to close before latch assembly 61 is actuated. Solenoid valve 42 requires a reversal in the polarity of the DC signal on line 72 before latch assembly 61 is actuated. Therefore, a loss of the DC signal does not cause upper string 25*a* to disengage from SSTT 60. The direct DC signal to solenoid valve 42, time delay relay 91, and the requirement for reversal in polarity add greatly to the safety of well testing.

Chamber 40*a* contains identical primary and secondary circuits which process the modem signal. These circuits receive command signals from line 72, validate the signals with control console 73, and actuate solenoid valves 41, 43, or 44 accordingly. Each circuit contains a microprocessor 100, modem 101, valve driver 102, analog to digital converter 103 and signal conditioner or amplifier 104 which comprise a portion of the means for opening and closing remotely located valves 62, 63 and 66. Various commercially available components can be satisfactorily used in the present invention. Examples of such components are microprocessors designated K9000 SERIES from Transwave Corporation, Cedar Valley Building, Vanderbilt, Pa. 15486; modems designated COLOR COMPUTER MODEM from Radio Shack; and analog to digital converters designated K9000 SERIES from Transwave. Modem signals from line 72 are directed to each signal bus 105 via filter and choke 106. Modem 101 translates the signal for its associated microprocessor 100. Microprocessor 100 responds to properly validated signals by causing its associated valve driver 102 to activate the appropriate solenoid valve 41, 43, or 44. Valve drivers 102 maintain solenoid valves 41, 43, and 44 energized by producing multiple DC output voltages or de-energize the appropriate solenoid by stopping the associated DC output voltage. Valve driver 102 directs each DC voltage to the appropriate solenoid valve. If line 72 should break, solenoid valve 42 remains closed (latch assembly 61 remains latched), and solenoid valves 41, 43, and 44 shift to their bleed position which causes SSTT valves 62 and 63 and retainer valve 66 to close. Choke and filter 106, signal conditioner 104, and modem 101 can be generally classified as peripheral interface adapter means. Analog to digital converter 103 and valve drive 102 function generally as a solenoid decoder. Signal bus and power supply 105 provide means for interconnecting microprocessor 100 and its programmable memory with the peripheral interface adapter means resulting in microprocessor 100 controlling solenoid valves 41, 43 and 44 in response to validated signals.

In the specific embodiment shown in this application, the primary circuit is also referred to as deep water actuator (DWA) system 1 and the secondary circuit as deep water actuator (DWA) system 2. Appendixes A and B show that control console 73 can monitor the status of either of these circuits.

Control console 73 monitors a wide variety of downhole parameters. FIG. 3B shows transducer 108 which monitors pressure in chamber 40*b* and sends an appropriate signal to console 73 via signal conditioner 104, analog to digital converter 103, microprocessor 100, modem 101, interconnected with each other by signal bus 105, choke and filter 106, and line 72. Other parameters, which can be measured and sent to console 73, are pressure and temperature of accumulator 50, voltage across solenoids 41, 42, 43, and 44, fluid pressure and temperature within test string 25, etc.

Figure 4:
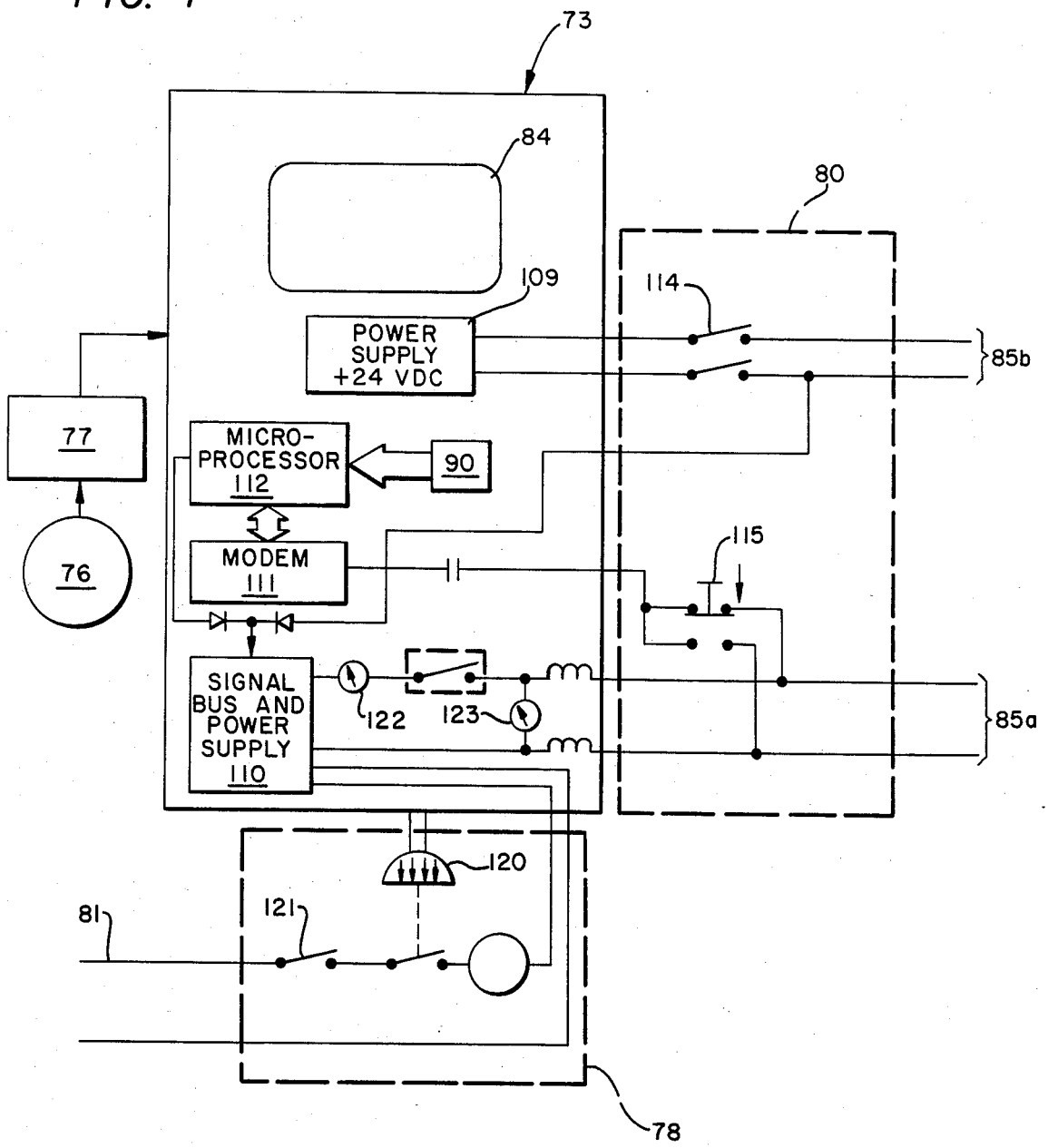
FIG. 4 is a block diagram of an electronic control cabinet and related components used in conjunction with the electrical systems of FIGS. 1 and 3A.
Figure 7:
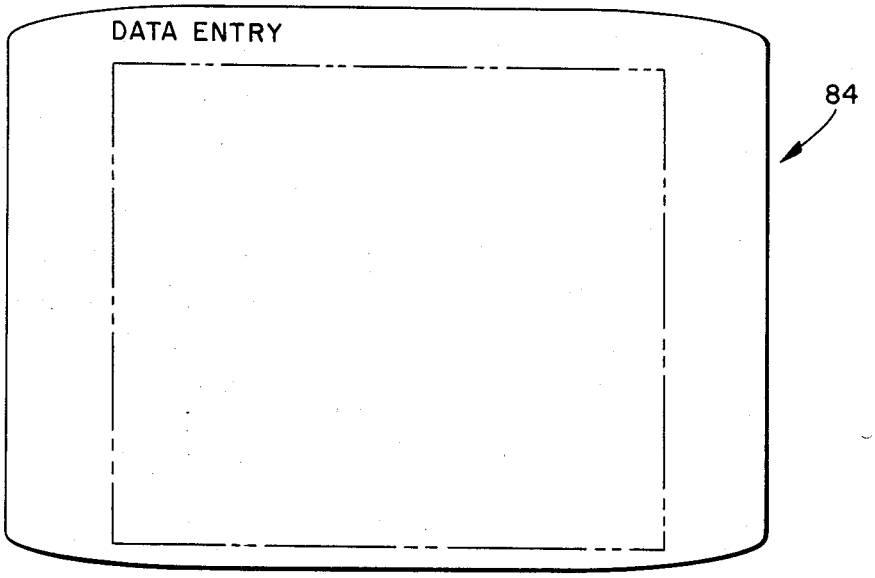
FIGS. 7, 8, and 9 represent various displays of information, equipment status, and command signals available on the electronic control cabinet of FIG. 4 during well testing.
Figure 8:
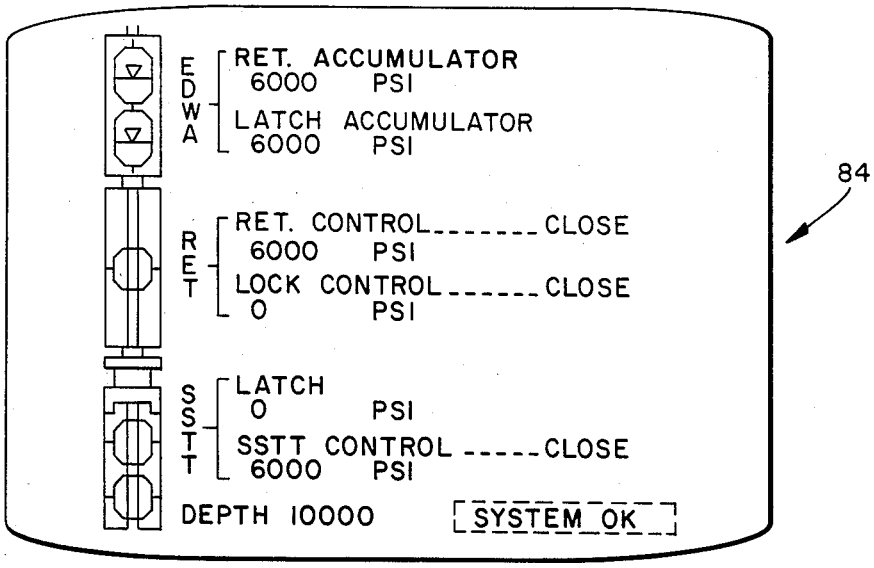
Figure 9:
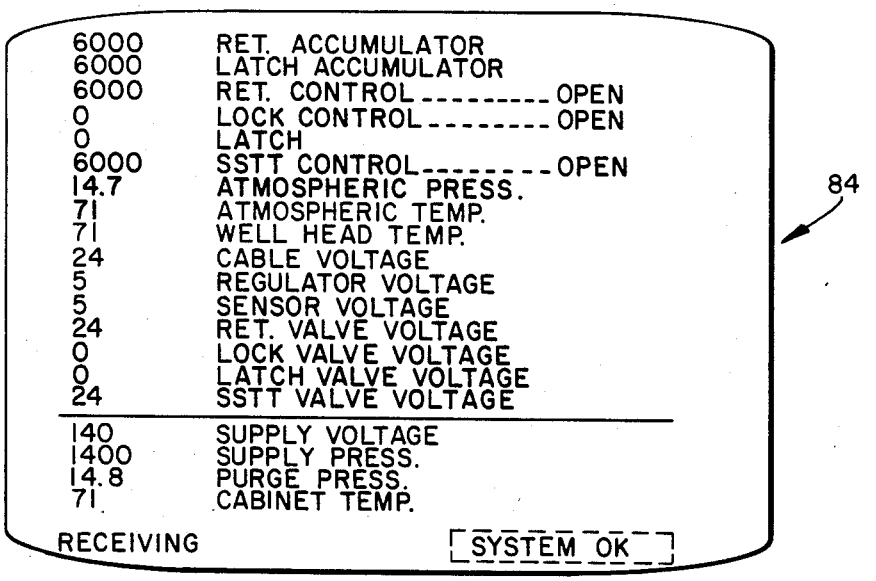

As best shown in FIG. 4, control console 73 contains circuitry similar to chamber 40. Major differences are DC power supply 109, monitor 84, and key pad 90. Signal bus 110, modem 111 and microprocessor 112 are similar to those contained in chamber 40. Key pad 90 provides input for command signals plus limited programmability and data entry capability at console 73. During maintenance or reprogramming, key pad 90 can be replaced by a standard computer keyboard to allow more extensive programmability of microprocessors 112 and 100 and their associated memory. Appendix A shows an example of the data entry capability of key pad 90. FIGS. 7, 8, and 9 show the displays available on monitor 84.

Power supply 109 provides a DC voltage which powers the electrical components shown in FIG. 3B and a signal to control latch assembly 61. Manual switch 114 can be closed to send this DC voltage via lines 85*b* to energize solenoid 42 which releases latch assembly 61. Manual switch 115 can be used to close SSTT valves 62 and 63. Preferably, manual switches 114 and 115, contained in explosion-proof box 80, are interlocked such that latch assembly 61 cannot be released until after SSTT valves 62 and 63 are closed.

FIG. 4 also shows an additional safety feature within box 78. Pressure switch 120 senses nitrogen pressure within console 73. If sufficient pressure is not present, switch 120 de-energizes console 73 resulting in the closure of SSTT valves 62 and 63 unless another console is satisfactorily operating.

Duplicate, redundant components are used throughout the electrical system so that the failure of one component will not cause the system to fail. Examples of such duplicate components are installing two control consoles 73 on drilling vessel 10 and the primary and secondary circuits in chamber 40.

System Operation

The following comments are made with reference to controlling the well testing system of FIG. 1 which has a hydraulically actuated SSTT, latch assembly, retainer valve, and retainer valve lock. SSTT valves 62 and 63 and retainer valve 66 are opened by control fluid pressure and closed by spring force when control fluid pressure is vented. Retainer valve 66 can be locked closed by supplying control fluid pressure to the lock mechanism (not shown). The vent path for the hydraulic system of FIG. 2 is from hydraulic lines 52, 53, 54, or 55 via the respective solenoid valve 41, 42, 43, or 44 and then into bore 20 of riser 19. Latch assembly 61 may also be mechanically disengaged as taught by Raulins U.S. Pat. No. 3,071,188, if desired. Those skilled in the art will readily see that the present invention can be adapted to control other remotely located valves or well tools.

Figure 6:
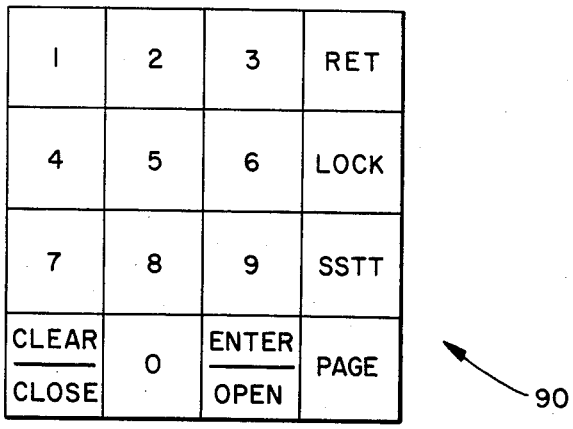
FIG. 6 is a schematic drawing of the key pad located on the electronic control cabinet of FIG. 4.

Personnel at console 73 can open or close SSTT valves 62 and 63, engage or disengage latch assembly 61, open or close retainer valve 66, and lock valve 66 closed as desired. SSTT 60 and retainer valve 66 are controlled by first depressing the appropriate key (RET, LOCK, or SSTT) on key pad 90 as shown in FIG. 6. Next, the desired command is entered into microprocessor 112 by depressing either the close key or open key on key pad 90. Each command and the response thereto is displayed on monitor 84. These functions can be repeatedly performed without having to retrieve SSTT 60 and/or testing string 25 from wellhead 14. Key pad 90 does *not* have a key which controls latch assembly 61. The programmable capabilities of control console 73 and the validation of command signals greatly enhance the reliability and safety of well testing. The combination of electrical and hydraulic systems results in quicker valve response. The present invention provides these improvements while at the same time requiring only a single hydraulic hose and a single conductor electrical line.

In a well testing system of the type shown in FIG. 1, several requirements must be satisfied to ensure safety. First, valves 62 and 63 must respond quickly to closure signals. As water depth increases, the response time for hydraulically operated valves also increases. By incorporating solenoid valves 41, 42, 43, and 44 into the present invention as pilot valves for other primary valves such as SSTT valves 62 and 63, the response time of an electrical signal to the solenoid valves results in much faster valve response time as compared to a purely hydraulic system. The downhole components of the well testing systems must respond only to valid signals and not electrical interference or noise. Signal validation or verification between microprocessors 100 and 112 provides this reliability.

Prior to unlatching upper test string 25*a* from SSTT 60, valves 62 and 63 must be closed. Also, when testing high pressure wells, particularly those having a large concentration of gas, retainer valve 66 should also be closed to prevent undesired escape of fluids from upper string 25*a*. If desired, the present embodiment provides a source of hydraulic fluid to lock retainer valve 66 closed. Multiple redundant interlocks are provided to ensure that valves 62 and 63 are closed before latch assembly 61 is actuated. For example, on loss of electrical power, solenoid valve 42 fails as is. Solenoid valve 42 can only be opened by reversing the polarity of the DC voltage on line 72. As previously noted, this DC signal is not controlled by any of the microprocessors. Various mechanical and electrical interlocks plus time delay relay 91 cause valves 62 and 63 to close before the DC signal activates solenoid valve 42.

Finally, control console 73 monitors critical parameters of the hydraulic system, electrical system, and well fluid being tested. Monitor 84 displays these parameters and warnings if required. Key pad 90 provides limited programmability and data entry including changing the safe operating limits for each parameter.

One of three displays as shown in FIGS. 7, 8, or 9 is present on monitor 84. Normally, the display shown in FIG. 8 is present on monitor 84 during well testing. Programming entries are made by first depressing the "PAGE" key on keyboard 90 which causes FIG. 7 to appear. The full text present on monitor 84 during this time is shown on attached Appendix A. Appendix B lists the various parameters and/or limits which can be entered into microprocessor 112 when Appendix A is displayed on monitor 84.

The display shown in FIG. 9 can also be selected by depressing the "PAGE" key. The left-hand side of the display in both FIGS. 8 and 9 shows the present status of the downhole equipment and system parameter. The right-hand side of both displays in FIGS. 8 and 9 shows commands which have been entered into the system. In FIG. 8, these commands are close retainer valve 66, close the lock for retainer valve 66, and close SSTT valves 62 and 63. In FIG. 9, open commands for these same components are shown. Both FIGS. 8 and 9 show a small box which reads "SYSTEM OK". If a critical parameter exceeds its preselected limits, microprocessor 112 will cause a red "WARNING" to appear in this same box and an audible warning to sound. Also, any parameter outside of its limits will be highlighted on the display of either FIG. 8 or 9.

The programmable capability of control console 73 provides excellent training for personnel. Various well conditions can be simulated and the appropriate response thereto displayed without having to actually operate downhole equipment. Control consoles 73 can be used in a classroom as effectively as onboard drilling vessel 10.

The word "RECEIVING" is displayed in the lower left-hand corner of FIG. 9. This word indicates that microprocessors 100 at the remote location are transmitting signals to microprocessor 112. For this particular embodiment, signals are transmitted from control console 73 for approximately one-half a second and received back for approximately 4 seconds. Any commands which are not validated cause microprocessor 112 to flash a warning on the display of both FIG. 8 and 9. Comparison of command signals between microprocessors must be validated before downhole equipment can be activated.

During normal well testing, solenoid valves 43 and 44 are electrically energized with their vent path closed and control fluid pressure flowing therethrough to open SSTT valves 62 and 63 and retainer valve 66. Solenoid valve 42 is de-energized with its vent path open and blocking control fluid pressure from latch assembly 61. Upon loss of all electrical power, solenoid valves 43 and 44 are de-energized which opens their respective vent flow paths and closes SSTT valves 62 and 63 and retainer valve 66. As previously noted, solenoid valve 42 is only actuated by reversing the polarity of the DC voltage on line 72. Diodes 98 and 99 as shown in FIG. 3B block the DC voltage present on line 72 from flowing to solenoid 42 prior to reversing the polarity. Therefore, a loss of electrical power does not cause upper test string 25*a* to disengage from SSTT 60. Loss of microprocessors 112 or 100 or other electrical component causing a failure in the modem signal results in a warning being flashed on monitor 84. However, solenoid valves 41, 42, 43, and 44 remain in their last position. Therefore, well testing can continue while personnel troubleshoot the electronic components.

The present invention can be readily adapted to control other well tools or remotely located valves. Those skilled in the art will readily see other embodiments without departing from the scope and spirit of the invention which is defined in the claims.

APPENDIX A

| |
|---|
| DATA ENTRY<br>TOTAL LINE LENGTH 10000 |
| KEY IN THE VALUE - PRESS "ENTER"<br>OR PRESS "ENTER" ONLY TO LEAVE<br>A VALUE UNCHANGED.<br>THIS PAGE INTERRUPTS COMMUNICATION WITH THE DWA. THEREFORE, THERE IS A TIME-OUT FEATURE WHICH CAUSES AUTOMATIC CYCLING AND RETURN TO NORMAL OPERATION IF NO KEY IS PRESSED FOR 10 (HOLD THE "PAGE" KEY DOWN FOR 3 SECONDS TO RETURN TO THIS PAGE.) |

APPENDIX B (EXAMPLES OF DATA ENTRY)

DEEP WATER ACTUATOR SYSTEM (1 or 2)
DEPTH
TOTAL LINE LENGTH (ELECTRIC)
MUD WEIGHT
MAXIMUM HYDRAULIC SYSTEM PRESSURE
MINIMUM SYSTEM ACCUMULATOR PRESSURE
MINIMUM LATCH ACCUMULATOR PRESSURE
RETAINER VALVE FULL OPEN PRESSURE
RETAINER VALVE FULL CLOSED PRESSURE
UNLATCH PRESSURE
SSTT FULL OPEN PRESSURE
SSTT FULL CLOSED PRESSURE

APPENDIX C

Glossary of Terms

Means for bypassing both microprocessors—DC signal on line 72 including diodes 98 and 99 which are electrically connected to solenoid valve 42.

Memory means—A portion of microprocessors 112 and 100.

Peripheral interface adapter means—Choke and filter 106, signal conditioner 104, and modem 101.

Pilot valve—Solenoid valves (41, 42, 43, and 44) which direct control fluid flow to the primary valves.

Primary valve—Hydraulically operated valves (62, 63, and 66) that control well fluid flow.

What is claimed is:

1. A method of operating remotely located primary valves comprising:

a. supplying operating fluid from a central location to each remotely located primary valve;

b. controlling the flow of operating fluid to each primary valve by actuation of a remotely located solenoid pilot valve;

c. entering commands for operation of each primary valve into a first microprocessor at the central location and transmitting the command to a second microprocessor remotely located near the pilot valves;

d. transmitting the command received by the second microprocessor back to the first microprocessor and validating that the command received at the remote location agrees with the command sent from the central location; and e. actuating the appropriate pilot valve following validation of the command received by the second microprocessor.

2. The method of operating remotely located primary valves as defined in claim 1 further comprising:

a. displaying a representation of each primary valve on a monitor at the central location;

b. indicating on the monitor each command sent by the first microprocessor;

c. indicating on the monitor validation of each command received by the second microprocessor; and d. indicating on the monitor the status of each primary valve based on information received from a remotely located sensor.

3. The method of operating remotely located primary valves as defined in claim 1 further comprising:

a. storing the operating fluid in remotely located accumulators; and b. indicating the status of each accumulator on the monitor at the central location.

4. The method of operating remotely located primary valves as defined in claim 1 further comprising:

a. setting preferred limits for system operating parameters in the first microprocessor;

b. comparing the value of each parameter as received from a remotely located sensor with its preferred limit; and c. displaying a warning sign on a monitor when a selected parameter exceeds its preferred limit.

5. The method of operating remotely located primary valves as defined in claim 1, further comprising the first micrprocessor sending a unique enable signal to the second microprocessor following validation.

6. A system for controlling well testing through an upper and lower test string with a subsea test tree connected therebetween and latch means to release the upper test string from the subsea test tree comprising:

a. first and second selectively programmable microprocessor means;

b. means for storing system operating limits in each microporcessor means;

c. means for chaning the operating limits in response to changes in well conditions;

d. means for communicating operating fluid pressure to the subsurface test tree and the latch means;

e. solenoid pilot valves controlling the flow of the operating fluid pressure to the subsea test tree and the latch means;

f. the first microprocessor means located at a central control console;

g. the second microporcessor means located near the solenoid valves;

h. means for transmitting signals between the first and second microporcessor means and validating the accuracy of the signals; and i. electronic circuits to control operation of the solenoid valves in response to validated signals.

7. The system for controlling well testing as defined in claim 6 wherein the means for storing comprises a key pad connected to the first microprocessor means and a monitor for selectively programming the first microprocessor means with limits for system parameters.

8. A system for controlling well testing as defined in claim 6 wherein the electronic circuits to control the solenoid valves further comprises:

a. peripheral interface adapter means;

b. a solenoid decoder connected between the peripheral interface adapter means and the solenoid valves; and c. signal bus means interconnecting the second microprocessor and its memory means with the peripheral interface adapter means to permit data flow therebetween and to enable the second microprocessor means to control the solenoid valves based on validated signals from the first microprocessor means.

9. The system for controlling well testing as defined in claim 8 wherein the means for communicating operating fluid pressure further comprises:

a. hydraulic fluid accumulator means located near the subsea test tree;

b. a manifold to supply operating fluid located near the central control console; and c. a hydraulic fluid conduit extending between the supply manifold and the accumulator means.

10. A system for controlling well testing as defined in claim 8 further comprising:

a. identical primary and secondary electronic circuits at the remote location for controlling the solenoid valves;

b. each primary and secondary circuit having its own second microprocessor and memory means; and c. the central console monitoring the status of either the primary or the secondary circuit.

11. A system for controlling and monitoring well testing including a subsurface test tree and related equipment comprising:

a. means for communicating operating fluid pressure to the subsurface test tree and related equipment;

b. solenoid valves controlling the flow of the operating fluid;

c. a first microprocessor and selectively programmable memory means to send and receive signals located at a central operating station;

d. a second microprocessor and selectively programmable memory means located near the solenoid valves to receive signals from the first microprocessor;

e. the second microprocessor transmitting commands received from the first microprocessor back to the first microprocessor for verification;

f. electronic circuits to control operation of the solenoid valves in response to verified commands from the second microprocessor; and g. means for bypassing both microprocessors to send an electrical signal directly to a selected solenoid valve.

12. The system as defined in claim 11 wherein the subsurface test tree is releasably attached to and controls formation fluid flow through a string of pipe further comprising:

a. hydraulically actuated latch means to release a portion of the pipe string from the subsurface test tree;

b. the selected solenoid valve controlling operating fluid communication with the latch means; and c. the selected solenoid valve responding only to a reversal in the polarity of the electrical signal supplied thereto.

13. The system as defined in claim 11 further comprising:

a. means for storing limits for selected parameters in the programmable memory means;

b. means for sensing the selected parameters and comparing measured values to the stored limits; and c. the first micorprocessor initiating a warning when any of the selected parameters exceeds its stored limit.

14. The system as defined in claim 13 wherein the means for storing the selected limits comprises a key pad and a monitor electrically connected to the first microprocessor.

15. The system as defined in claim 13 further comprising:

a. peripheral interface adapter means;

b. a solenoid decoder means; and c. data bus means interconnecting the second.microprocessor with the signal from the first microprocessor, the solenoid decoder means and the peripheral interface adapter means to permit data flow therebetween and to enable the second microprocessor to control the solenoid valves in response to verified commands.

16. The system as defined in claim 11 further comprising:

a. a time delay relay controlling the electrical signal to the selected solenoid valve; and b. a power sensing relay to de-energize the signal to the other solenoid valves prior to the time delay relay sending the electrical signal to the selected solenoid valve.

17. The system as defined in claim 16 wherein the selected solenoid valve receives a DC signal and the microprocessors communicate with each other by a modem signal.

18. An electronic circuit to control the operation of valves remotely located from a central control console comprising:

a. selectively programmable microprocessor means to receive signals from the control console;

b. solenoid valves electrically connected to and controlled by the electronic circuit;

c. the microprocessor means and solenoid valves located adjacent to each other;

d. peripheral interface adapter means;

e. a solenoid decoder connected between the peripheral interface adapter and the solenoid valves;

f. the microprocessor means transmitting commands received from the central control console back to the console for validation; and g. signal bus means interconnecting the microprocessor means with the peripheral interface adapter to permit data flow therebetween and to enable the microprocessor means to control the solenoid valves based on validated signals.

19. An electronic circuit as defined in claim 18 further comprising:

a. means for receiving both a DC voltage signal and a modem computer signal from the central control console;

b. means for bypassing the microprocessor means to send the DC voltage signal directly to a selected solenoid valve; and c. the selected solenoid valve responding only to a reversal in polarity of the DC voltage signal supplied thereto.

20. An electronic circuit as defined in claim 18 further comprising means for measuring selected parameters associated with the circuit or the valves and transmitting the measured value to the central control console.

21. An electronic circuit electrically connected to and controlling the operation of solenoid valves remotely located from a central control console comprising:

a. selectively programmable microprocessors and their associated memory to receive modem signals from the control console;

b. the microprocessors and solenoid valves located adjacent to each other;

c. the microprocessors transmitting commands received from the central control console back to the console for validation;

d. peripheral interface adapter means;

e. a solenoid decoder connected between the peripheral interface adapter means and the solenoid valves;

f. signal bus means interconnecting the microprocessors with the peripheral interface adapter means to permit data flow therebetween and to enable the microprocessors to control the solenoid valves based on validated signals;

g. means for receiving both a DC voltage signal and the modem signal from the central control console;

h. means for bypassing the microprocessors to send the DC voltage signal directly to a selected solenoid valve; and i. the selected solenoid valve responding only to a reversal in polarity of the DC voltage signal supplied thereto.

22. An electronic circuit as defined in claim 21 further comprising identical primary and secondary circuits to process the modem signal from the central control console whereby loss of one microprocessor does not prevent the electronic circuit from controlling the solenoid valves.

23. An electronic circuit as defined in claim 22 wherein the peripheral interface adapter means and solenoid decoder hold the solenoid valves in their last position upon loss of the modem signal.

* * * * *